United States Patent [19]

White

[11] Patent Number: 4,697,641

[45] Date of Patent: Oct. 6, 1987

[54] SINKER BAR ASSEMBLY

[75] Inventor: Bill W. White, Duncan, Okla.

[73] Assignee: Halliburton Company, Duncan, Okla.

[21] Appl. No.: 883,391

[22] Filed: Jul. 8, 1986

Related U.S. Application Data

[62] Division of Ser. No. 723,773, Apr. 15, 1985, Pat. No. 4,624,308.

[51] Int. Cl.[4] ..... E21B 23/00; E21B 47/00

[52] U.S. Cl. ..... 166/243; 166/65.1; 166/385

[58] Field of Search ..... 166/250, 243, 241, 385; 285/35

[56] References Cited

U.S. PATENT DOCUMENTS

| | | | |
|---|---|---|---|
| Re. 26,458 | 9/1968 | Moore | 166/250 X |
| 2,847,075 | 8/1958 | Halbrook et al. | 166/241 |
| 2,944,603 | 7/1960 | Baker et al. | 166/241 X |
| 3,001,802 | 9/1961 | Rebman et al. | 285/35 |
| 4,063,592 | 12/1977 | Youmans | 166/243 X |
| 4,295,528 | 10/1981 | Carmody | 166/385 X |
| 4,574,892 | 3/1986 | Grigar et al. | 166/385 X |

*Primary Examiner*—James A. Leppink
*Assistant Examiner*—Matthew Smith
*Attorney, Agent, or Firm*—Joseph A. Walkowski

[57] ABSTRACT

The cable head provides an $H_2S$ resistant assembly which includes a weak link therein substantially isolated from any stress other than tensile stress induced by the logging cable. The cable head also provides a fishing neck at the top of the tool string after the weak link is severed and the wireline retrieved. Moreover, the logging cable is positively secured to the cable head by a force-fit wedge, and the design thereof ensures that parting of the weak link also provides for a positive mechanical disengagement of the logging cable from the cable head. Finally, an external sinker bar has been provided which mounts externally of the cable head, surrounding the logging cable above the cable head and mechanically interlocking therewith; such sinker bars may be run above the cable head in series, each interlocking with the one below it.

4 Claims, 10 Drawing Figures

SINKER BAR ASSEMBLY

This application is a division of application Ser. No. 723,773, filed Apr. 15, 1985, now U.S. Pat. No. 4,624,308.

BACKGROUND OF THE INVENTION

When logging tools are run into the boreholes of oil and gas wells they are generally suspended from logging "wirelines" or cables which run from a reel at the surface of the earth to the depth of the formation or formations to be logged. The device by which the logging tool instrument housings or "tool string" are suspended from the wireline is generally termed a cable head.

Prior art cable heads have incorporated therein a "weak link" or "weak point" at which point the cable head is designed to fail at a predetermined tensile stress in the event the tool string becomes stuck in the borehole, thus permitting retrieval of the wireline and running a fishing tool, as known in the art, to attempt to retrieve the logging tool string. Such prior art cable heads may leave a length of cable on top of the tool string or result after separation in a configuration at the top of the string which is difficult to engage with fishing tools. Additionally, the manner in which the logging cables are secured to prior art cable heads, with a wedging action primarily dependent upon the weight of the tool string as it is suspended in the borehole, may result in premature failure at the wedge assembly rather than at the desired weak link at the predetermined stress. Moreover, many prior art cable heads are not susceptible to use in boreholes containing sour gas, or $H_2S$, due to their design as well as the vulnerability to $H_2S$ of components in the cable head assembly.

Finally, when running logging tools in a borehole, it is often necessary to add weight to the tool string to counteract the buoyancy provided by the hollow logging tool instrument housings. The prior approach to adding weight to the string was to incorporate weights or "sinker bars" in the tool string itself. This approach not only required that the sinker bar include a means of transmitting an isolated electrical signal through it, but required that the sinker bar have a means of sealing pressure out of the instrument string.

SUMMARY OF THE INVENTION

In contrast to the prior art, the cable head of the present invention provides an $H_2S$ resistant assembly which includes a weak link therein substantially isolated from any stress other than tensile stress induced by the logging cable. The cable head also provides a fishing neck at the top of the tool string after the weak link is severed and the wireline retrieved. Moreover, the logging cable is positively secured to the cable head by a force-fit wedge, and the design thereof ensures that parting of the weak link also provides for a positive mechanical disengagement of the logging cable from the cable head. Finally, an external sinker bar has been invented which mounts externally of the cable head of the present invention, surrounding the logging cable above the cable head and mechanically interlocking therewith; such sinker bars may be run above the cable head in series, each interlocking with the one below it.

BRIEF DESCRIPTION OF THE DRAWINGS

The cable head of the present invention will be more fully understood by a review of the following detailed description of a preferred embodiment thereof in conjunction with the accompanying drawings, wherein.

DETAILED DESCRIPTION OF A PREFERRED EMBODIMENT OF THE INVENTION

Figure 1A:
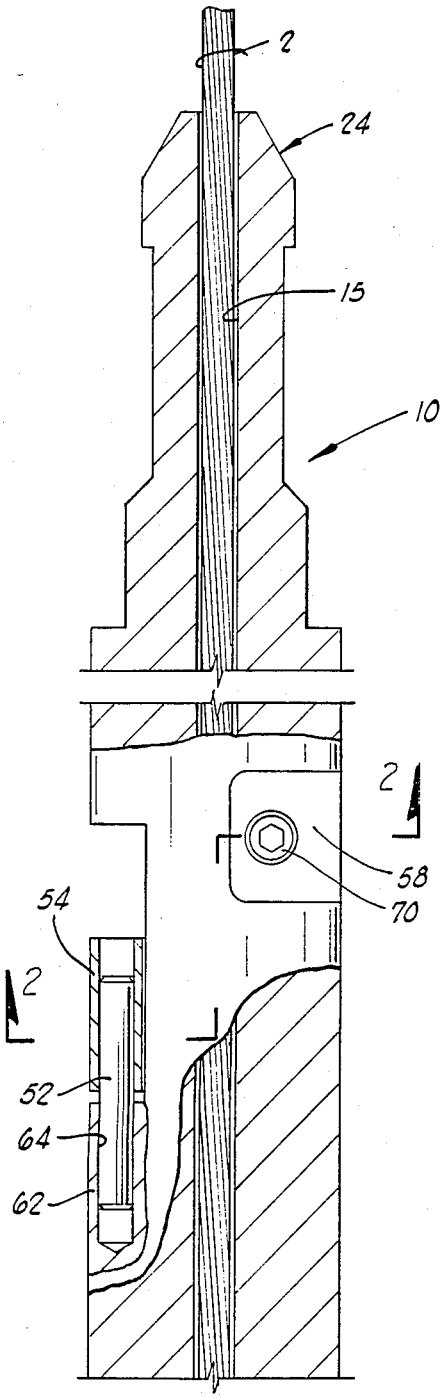
FIGS. 1A through 1D depict a vertical full sectional elevation of the cable head and attached sinker bar assembly of the present invention.

Referring to FIGS. 1–7 of the drawings, logging cable 2 is shown extending vertically through sinker bar assembly 10 (see FIGS. 1A and 1B) of the present invention. Sinker bar assembly 10 comprises cooperating sinker bars 12 and 14 (see FIG. 6) which are hinged together at one side and which close clamshell fashion defining cable bore 15 about the exterior of logging cable 2 in non-gripping relationship thereto. Specifically, sinker bar 12 is a half-cylindrical body 13 including a radially flat edge 16 at the top thereof, below which first chamfered arcuate surface 18 leads to first half-cylindrical surface 20, ending at radially flat inwardly extending arcuate shoulder 22. Below shoulder 22, half-cylindrical neck 26 extends downward to a second chamfered arcuate surface 28, leading outwardly to a second half-cylindrical surface 30, terminating at radially flat outwardly extending arcuate surface 32. The aforesaid components comprise one side of fishing neck 24 as shown in FIG. 1A. The remainder of the exterior of sinker bar 12 comprises third half-cylindrical surface 34, extending to arcuate radially flat bottom edge 36.

The interior of sinker bar 12 comprises arcuate cable bore wall 38 running from the top of bar 12 to the lower portion thereof, where it meets upper half-cylindrical bore wall 40 defined at its top by arcuate radially flat surface 42 and at its bottom by arcuate radially flat shoulder 44. Below shoulder 44, medial half-cylindrical bore wall 46 extends downward to beveled arcuate surface 48 leading radially outward to lower half-cylindrical bore wall 50, which ends at bottom edge 36 of bar 12.

Figure 6:
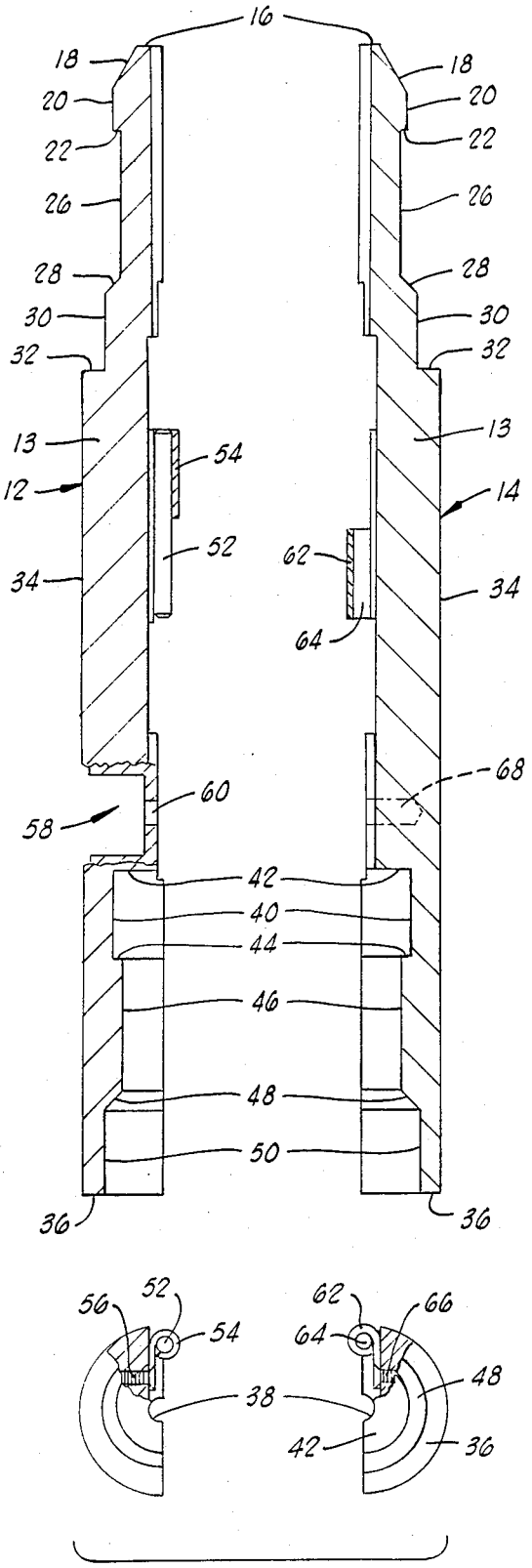
FIG. 6 comprises a vertical sectional elevation of the components of a two-piece sinker bar assembly which may be employed with the cable head of the present invention, as well as a partial section lower end view of the sinker bar assembly components.
Figure 7:
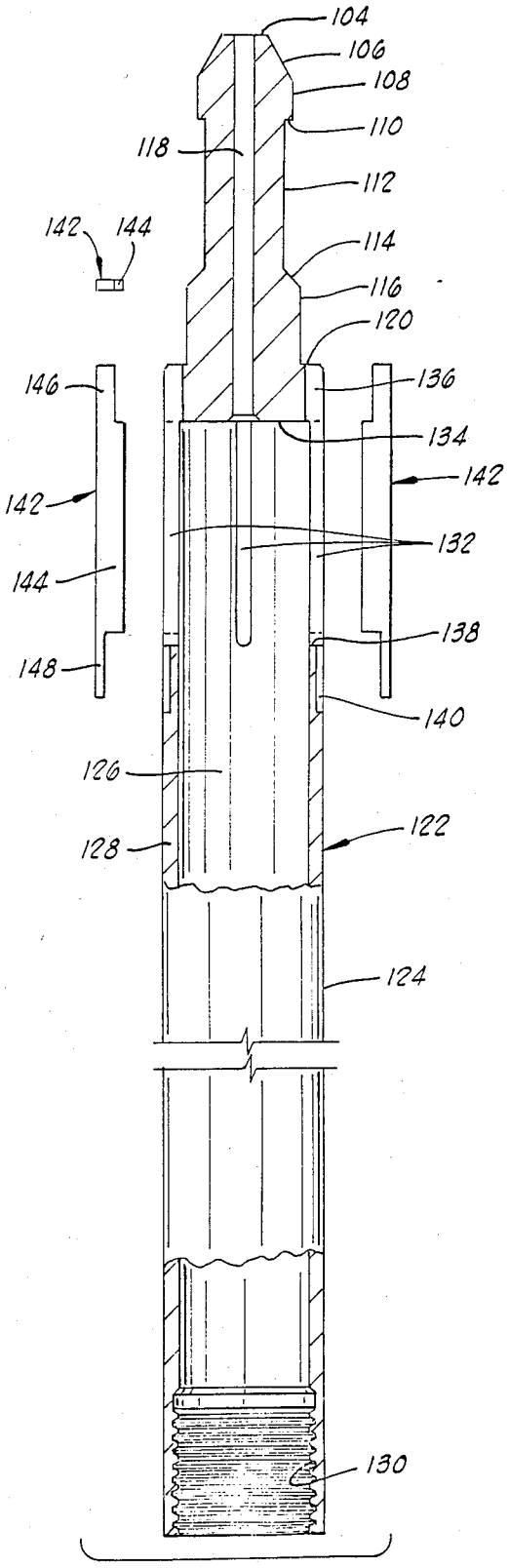
FIG. 7 is an exploded vertical full sectional elevation of the head case employed in the cable head of the present invention.

Sinker bar 14 includes the same structural features set forth above with respect to bar 12, which are designated by like numerals in FIG. 6. Sinker bars 12 and 14 are not, however, identical.

Bar 12 includes hinge pin 52 protruding longitudinally downward from pin bracket 54, which is secured to body 13 by screws 56. Also included in bar 12 is recess 58 in body 13 to which extends lock bolt aperture 60 through the wall of body 13.

Bar 14 includes hinge 62 having longitudinal pin bore 64 therethrough, hinge 62 being secured to body 13 of bar 14 by screws 66. Below hinge 62, threaded lock bolt bore 68 extends laterally into the wall of body 13.

When assembled together, sinker bars 12 and 14 surround cable 2 and are locked together by hex lock bolt 70 which engages threaded lock bolt bore 68 through aperture 60, which is aligned therewith when sinker bar assembly 10 is closed about cable 2.

Returning to FIG. 1B, a fishing neck 102 at the top of cable head 100 extends into fishing neck bore 80 defined between bars 12 and 14 at the bottom of sinker bar assembly 10. Fishing neck 102 includes annular top surface 104, chamfered shoulder 106, cylindrical head surface 108, radially flat annular shoulder 110, cylindrical neck 112, beveled shoulder 114, and cylindrical base 116. Cable bore 118 runs axially through fishing neck 102. Shoulder 110 of cable head fishing neck 102 is supported by shoulders 44 of sinker bar assembly in fishing neck bore 80.

Below fishing neck 102 from annular shoulder 120 on the exterior of cable head 100, cylindrical exterior 124 runs to the bottom of head case 122, of which fishing neck 102 is an integral part. As can readily be seen in FIG. 7, head case 122 is substantially tubular below fishing neck 102, having interior bore 126, with wall 128 between bore 126 and exterior surface 124. At the bottom of bore 126, wall 128 is internally threaded at 130. Immediately below cable bore 118, a plurality of longitudinal radially oriented slots 132 extend at 90° intervals about the circumference of head case 122 through wall 128, slots 132 continuing upwardly from upper bore end 134 to shoulder 120 as grooves 136, and downwardly from slot edge 138 as shallower grooves 140. A plurality of keys 142 are welded into slots 132 and grooves 136 and 140, each key 142 including a key head 144 protruding laterally radially inward into bore 126. Each upper key segment 148 is secured (welded) into a groove 136, while lower key segment 148 is secured into a groove 140.

Referring again to FIG. 1B, threaded grease injection aperture 150 is shown extending obliquely into bore 126 from cavity 152, the purpose for which will be explained hereafter. A grease fitting (not shown) will be threaded into aperture 150 when cable head 100 is assembled.

Figure 4:
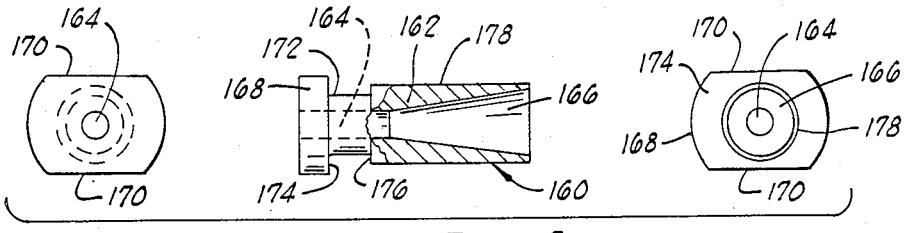
FIG. 4 comprises front, side and rear elevations, with side elevation in partial section, of the wedge bar employed in the present invention.

The end 154 of cable 2 extends into bore 126, and the outer strands 156 thereof are separated from the inner, concentric conductor 158 having an insulating sheath thereabout. Strands 156 are fanned out after cable end 154 is pulled through wedge base 160. Wedge base 160, as can be seen in FIG. 4, comprises a hollow body 162 having an axial, cylindrical bore 164 from the front (top) thereof which enters a frusto-conical bore 166 extending outward to the rear (bottom) thereof. The exterior of wedge base 160 comprises a head 168 in the form of a short cylinder having flat, truncated edges 170 on diametrically opposite sides thereof. Below head 168 is a narrower, cylindrical neck 172, defined between radially flat shoulders 174 and 176. The lower exterior of wedge base 160 comprises cylindrical tail 178.

Figure 1B:
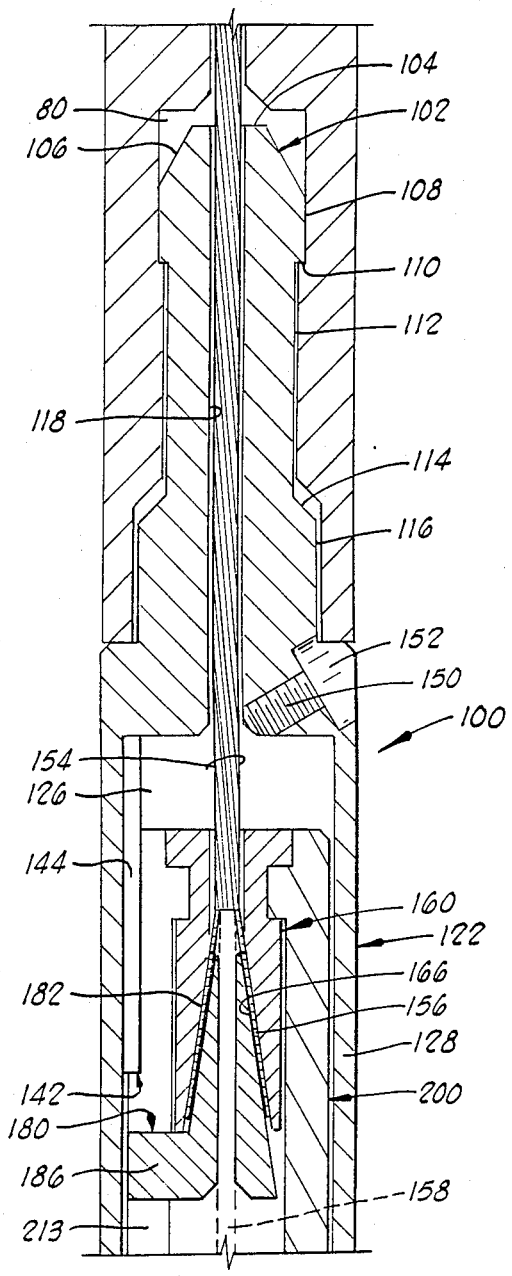
Figure 1C:
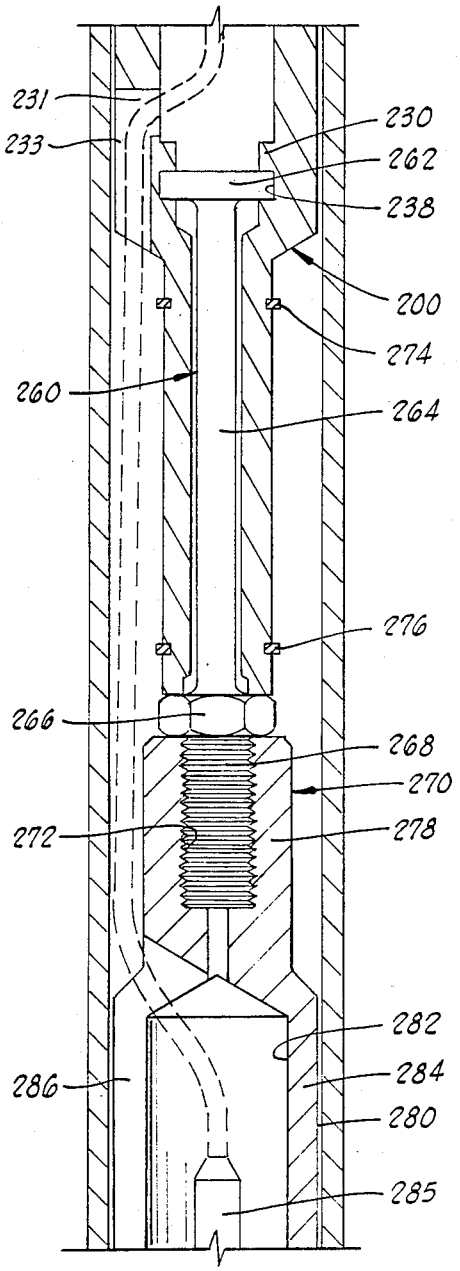
Figure 1D:
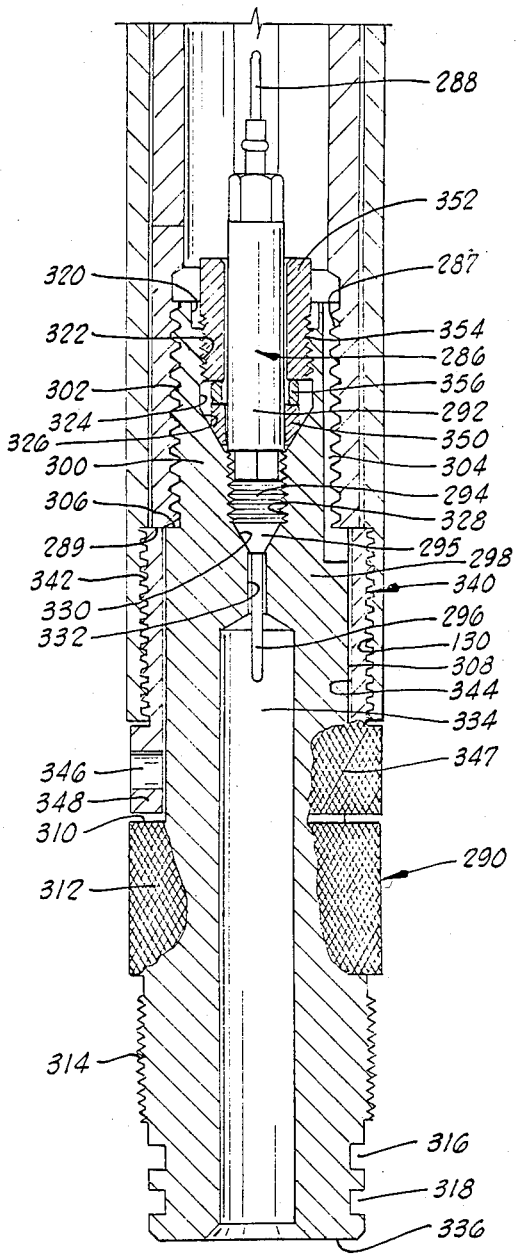
Figure 2:
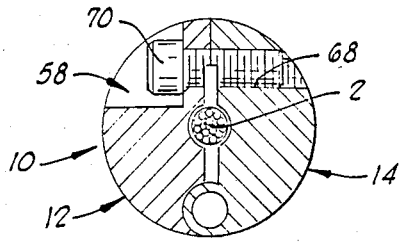
FIG. 2 comprises a section taken through line 2—2 of FIG. 1A.
Figure 3:
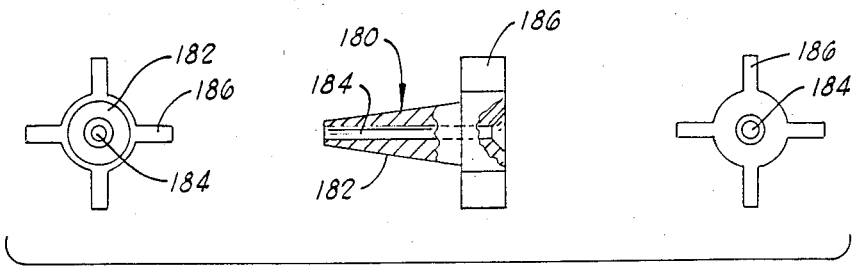
FIG. 3 comprises front, side and rear elevations, with side elevation in partial section, of the drive wedge employed in the present invention.

After cable strands 156 are fanned out in frustoconical bore 166 of wedge base 160, drive wedge 180 is mechanically driven into frusto-conical bore 166, so that frusto-conical leading outer surface 182 (see FIG. 3) wedges strands 156 against bore 166 and strands 156, wedge base 160, and drive wedge 180 are jammed together securely. As can be seen in FIG. 1B, cable conductor 158 extends through axial bore 184 drive wedge 180, and the ultimate travel of drive wedge 180 into wedge base 160 is halted by four 90° circumferentially spaced radially extending legs 186 at the rear of drive wedge 180.

Figure 5:
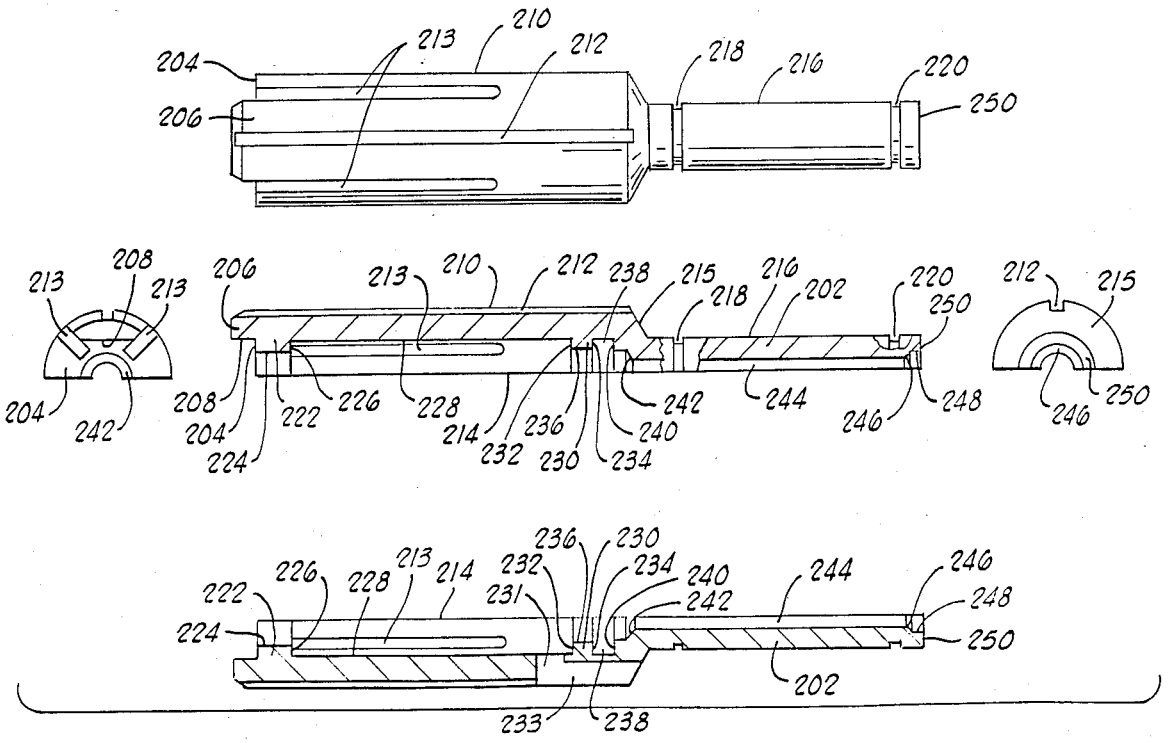
FIG. 5 depicts a two-piece link slip employed in the present invention in side elevation, in side sectional elevation, as well as front and rear elevations of one-half of the link slip.

Clasped about the assembly cable strand 156, wedge base 160 and drive wedge 180 is two piece link slip 200, also shown in FIG. 5. Link slip 200 comprises two mirror-image sections 202, each having a half-cylindrical shape. Each section 202 includes an arcuate front edge 204, beyond which extends a nose 206 having flat inside edge 208. Leading exterior surface 210, behind edge 204 and nose 206, is half-cylindrical in configuration, the outer surface of nose 206 matching leading exterior surface 210 in curvature. Longitudinally oriented groove 212 extends from the front of nose 206 to the rear of leading exterior surface 210. Two 90° spaced circumferential slots 213 extend through the wall of leading surface 210 from the mid-portion thereof to the front of each section 202, each slot 213 being disposed at a 45° rotation to the horizontally flat side edge 214 thereof. Behind leading exterior surface 210, oblique arcuate edge 215 tucks inwardly to trailing exterior surface 216, also of half-cylindrical configuration. Two circumferential grooves, 218 and 220, extend about the periphery of trailing exterior surface 216.

The interior of each link slip section 202 comprises first shoulder 222 defined between front edge 204, half-cylindrical inner surface 224 and arcuate shoulder 226. Behind first shoulder 22, half-cylindrical bore wall 228 extends to second shoulder 230, defined by leading and trailing arcuate shoulders 232 and 234 and half-cylindrical inner surface 236. Tensile bar head recess 238 lies behind second shoulder 230 and in front of arcuate surface 240, behind which the interior of each section 202 necks down at chamfered surface 242 to half-cylindrical tensile bar bore wall 244, fanning out at the rear of section 202 at chamfered surface 246 to recess 248, which extends to trailing edge 250. Immediately above second shoulder 230, aperture 231 extends from the interior of each link slip section 202 to longitudinal slot 233 in the exterior thereof (only one aperture 231 and slot 233 have been shown in FIG. 1C and FIG. 5 for clarity).

In the assembled state of cable head 100, as can readily be seen in FIG. 1B, truncated top and bottom edges 170 on wedge base head 168 are disposed between the two noses 206 on top and bottom sections 202 of link slip 200. Neck 172 of wedge base 160 extends between shoulders 222 of link slip 200, tail 178 being disposed behind shoulders 222. Each of the four legs 186 of drive wedge 180 is disposed in a slot 213 in link slip 200, the lower left-hand side of the assembly in FIG. 1B having been rotated to show this relationship with greater clarity. Cable connector 158 extends through an aperture 231 in a link slip 202 to slot 233 in the exterior thereof behind drive wedge 180.

Tensile bar 260 is disposed primarily within link slip 200, round head 262 of tensile bar being gripped in tensile bar head recess 238 between second shoulder 230 and arcuate surface 240 on the interior of link slip 200. The body 264 of tensile bar 260 extends between the tensile bar bore walls 244 of link slip 200, with hexagonal nut 266 extending laterally outward below trailing edge 250. Threaded foot 268 of tensile bar 260 is engaged by threaded bore 272 at the top of mooring bar 270. Link slip sections 202 are maintained about wedge base 160, drive wedge 180 and tensile bar 260 by retaining rings 274 and 276 disposed in grooves 218 and 220.

Mooring bar 270 comprises cylindrical nose 278 having axial threaded bore 272 extending thereinto. Behind nose 278, mooring bar 270 increases in diameter to exterior surface 280, at which point the remainder of mooring bar 270 is tubular in nature, having interior bore wall 282 and relatively thin wall 284. Longitudinal slot 286 extends through wall 284 from exterior surface 280 to bore wall 282, cable conductor 158 passing therethrough after trailing beside the exterior link slip 200 inside head case 122. At the end of cable conductor 158, a Kalrez® $H_2S$ resistant elastomeric boot 285 surrounds a female connector therein (not shown) which engages the upper male end 288 of a feedthrough connector 286 disposed in seal base 290. The lower interior of mooring bar 270 terminates with threaded bore wall 287, which extends to bottom edge 289.

Feedthrough connector 286 includes upper male end 288, cylindrical glass barrel 292, and threaded lower portion 294 including seal head 295 and lower male end 296.

Seal base 290 includes body 298 having neck 300 with external threads 302 thereon, grease weep slot 304 extending longitudinally along neck 300 past annular shoulder 306 and communicating with exterior cylindrical surface 308 of body 298. Cylindrical surface 308 terminates at radially outwardly extending surface 310, below which knurled cylindrical surface 312 reaches to threaded surface 314. The bottom of seal base 290 includes circumferential O-ring channels 316 and 318.

The interior of seal base body 298 includes axial smooth-walled entry bore wall 320, below which threaded compression nut bore 322 reaches to smooth intermediate bore wall 324. Frusto-conical wedge seal bore wall 326 tapers inwardly to threaded feedthrough connector anchor bore 328, which in turn leads to frusto-conical feedthrough connector seal bore 330, narrow axial connector bore 332 leading downward therefrom to larger logging tool connector anchor bore 334 therebelow, opening on lower face 336 of seal base 290. Neck 300 of seal base 290 extends into head case 122 at the bottom thereof, and into mooring bar 270, threads 302 on seal bore neck 300 engaging threaded bore wall 286 thereof until annular shoulder 306 is made up to the bottom edge 289 of mooring bar 270.

Tubular head bolt 340, having threaded neck 342, is made up to internal threads 130 at the base of cable head 122 about cylindrical surface 308 of seal base 290, inner bore wall 344 being of slightly larger diameter than surface 308. The assembly of mooring bar 270 with seal base 290 is thus maintained in place by head bolt 340 secured to cable head 122. Vent ports 346 extend radially from the knurled exterior 347 of annular head bolt base 348 to inner bore wall 344.

Inside seal base 290, threaded lower portion 294 of feedthrough connector 286 is made up to threaded feedthrough connector anchor bore 328, seal head 295 bearing against seal bore 330. Annular wedge washer 350 is forced against wedge seal bore wall 326 by compression nut 352, which is made up at threads 354 to threaded compression nut bore 322, slip washer 356 residing therebetween.

OPERATION OF A PREFERRED EMBODIMENT OF THE INVENTION

Referring again to the drawings, and in particular FIGS. 1A–1D, operation of the sinker bar assembly and cable head 100 will be desribed.

When cable head 100 (assembled as shown in FIGS. 1A–1D) is to be run into a well bore at the end of logging cable 2, a tubular housing containing a string of logging tools (not shown) is secured to the bottom thereof by threads 314, O-rings (not shown) in channels 316 and 318 providing a fluid tight housing therebetween. A grease fitting is inserted in grease injection aperture 150, and silicon grease is injected therethrough into bore 126 until it fills all of bore 126 and travels through grease weep slot 304 and between head bolt 340 and seal base 290 until it oozes out vent ports 346 on head bolt 340. This purging of bore 126 with silicon grease adds $H_2S$ resistance to the cable head 100, even though the materials thereof are preferably made of sour gas resistant materials such as high alloy austenitic stainless steels, nickel base alloys or cobalt base alloys, all of which are known in the art.

Further, unlike prior art cable heads which require relatively fragile elastomeric O-rings to effect an internal pressure tight seal about feedthrough connectors leading to the logging tools therebelow, cable head 100 employs two metal-to-metal compression seals: between seal head 295 and connector seal bore 330; and between wedge nut 350, cylindrical mid-portion 292 of feedthrough connector 286 and wedge sea bore wall 326.

Depending upon the number of logging tool instrument housings secured to the bottom of cable head 100, the tool string may be buoyant due to the hollow, tubular nature of the string. To offset this buoyancy, one or more sinker bar assemblies 10 are clamped about logging cable 2 above cable head 100 in the manner hereinbefore described, fishing neck bore 80 of sinker bar assembly 10 constraining fishing neck 102 of cable head 100. By utilizing sinker bar assembly 10 above the tool string, no pressure sealing between the bars and instrument housings and no means of transmitting an isolated electrical signal through the sinker bar are required as in the prior art.

When cable head 100 is lowered into a borehole for logging, there may occur a situation where the tool string secured thereto becomes irreparably stuck. In such an instance, it is desired that the cable 2 be retrieved, so that a clear, unobstructed fishing neck 24 (or 102 if no sinker bars 10 are employed) will be available for a fishing tool to engage in attempts to retrieve the string. To permit retrieval of cable 2, a predetermined tensile load is applied by a winch at the surface. Upon reaching the tensile failure load of tensile bar 260, which is applied thereto through cable strands 156, link slip 200, wedge base 160 and drive wedge 180, tensile bar body 264 parts. This will cause link slip 200 to move toward the top of bore 126. However, before link slip 200 reaches the top of bore 126, legs 186 of drive wedge 180 will contact keys 144 extending through slots 132 in head case 122, drive wedge 180 will be "pulled" out of wedge base 160, and cable strands 156 will be released from therebetween. Cable end 154 will then be free to travel upward through wedge base bore 164, through cable bore 118 of fishing neck 102 and through sinker bar assembly 10, after which it is reeled in to the surface.

It should be noted that keys 142 of cable head case 122 transmit any torque acting upon link slip 200 to case 122, by virtue of keys 142 extending into slots 213 of link slip 200. Likewise, the interaction of truncated edges 170 of wedge base 160 on noses 206 of link slip 200 transmits torque from wedge base 160 of link slip 200. As can easily be seen, tensile bar 260 is isolated from any significant torque as its head 262 can rotate in tensile bar head recesses 238 in link slip 200. Also, tensile bar body 264 is isolated from bending stresses by interaction of tensile bar head 262 with head recesses 238 of link slip 200 and the trailing edge 250 thereof with hexagonal nut 266. It can thus be assured that tensile bar 260 will fail in tensile stress as desired rather than prematurely in shear or in bending.

It is apparent that a novel and unobvious cable head and sinker bar has been disclosed in the form of a preferred embodiment, numerous additions, deletions and modifications thereto being possible without departing from the spirit and scope of the claimed invention:

I claim:

1. A sinker bar assembly for use with downhole tools suspended from a cable in a well bore, comprising:

body means having a longitudinally extending cable bore therethrough from the top to a lower portion thereof;

fishing neck means including a head extending laterally beyond a neck disposed therebelow at the top of said body means; and fishing neck bore means extending from the bottom of side body means upward to the lower extent of said cable bore, said fishing neck bore means having a configuration of substantially identical size and shape to that of said fishing neck means to receive and secure therein a fishing neck.

2. The sinker bar assembly of claim 1, wherein said body means comprises two sinker bars and fastening means to secure said bars together, said cable bore and said fishing neck bore means being defined between said bars when same are secured together.

3. The sinker bar assembly of claim 2, wherein said fastening means comprises hinge means affixed to longitudinally adjacent edges of said sinker bars, whereby said sinker bar assembly may be closed clamshell fashion about said cable, and bolt means, whereby said sinker bar assembly may be secured in said closed position.

4. The sinker bar assembly of claim 3, wherein each of said sinker bars comprises a half-cylindrical shape having a head at the top exterior thereof and a neck therebelow, and has on its interior an arcuate longitudinally extending groove defining the wall of one-half of said cable bore, said groove extending from the top of said head downward to a radially extending surface, said radially extending surface ends at an upper half-cylindrical downwardly-extending bore wall which terminates in a radially inwardly extending annular shoulder, below said shoulder a lower half-cylindrical bore wall extends downwardly to the bottom of said body means, said radially extending surface, said upper bore wall, said annular shoulder and said lower bore wall defining substantially one-half of said fishing neck bore means.

* * * * *

UNITED STATES PATENT AND TRADEMARK OFFICE

CERTIFICATE OF CORRECTION

PATENT NO. : 4,697,641

DATED : October 6, 1987

INVENTOR(S) : Billy W. White

It is certified that error appears in the above-identified patent and that said Letters Patent is hereby corrected as shown below:

In column 3, line 43, delete "148" and insert --146-- therefor.

In column 5, line 49, delete "286" and insert --287-- therefor.

In the claims, claim 1, line 29, delete "side" and insert --said-- therefor.

Signed and Sealed this

Ninth Day of February, 1988

*Attest:*

DONALD J. QUIGG

*Attesting Officer*

*Commissioner of Patents and Trademarks*